US006196174B1

(12) United States Patent
Wada et al.

(10) Patent No.: US 6,196,174 B1
(45) Date of Patent: Mar. 6, 2001

(54) VALVE TIMING CONTROL SYSTEM FOR INTERNAL COMBUSTION ENGINE

(75) Inventors: Koji Wada; Atsuko Hashimoto, both of Tokyo (JP)

(73) Assignee: Mitsubishi Denki Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/477,346

(22) Filed: Jan. 4, 2000

(30) Foreign Application Priority Data

Jan. 28, 1999 (JP) ..... 11-020370
Jul. 9, 1999 (JP) ..... 11-195868

(51) Int. Cl.[7] ..... F01L 1/34; F02D 13/02

(52) U.S. Cl. ..... 123/90.15; 123/90.17; 123/90.19

(58) Field of Search ..... 123/90.15, 90.16, 123/90.17, 90.18, 90.19, 90.31, 90.33

(56) References Cited

U.S. PATENT DOCUMENTS 5,628,286 * 5/1997 Kato et al. ..... 123/90.15
5,957,095 * 9/1999 Kako ..... 123/90.15
6,006,708 * 12/1999 Ken et al. ..... 123/90.17
6,024,061 * 2/2000 Adachi et al. ..... 123/90.17
6,079,381 * 6/2000 Morikawa ..... 123/90.15

FOREIGN PATENT DOCUMENTS 6-159021 6/1994 (JP) .

* cited by examiner

*Primary Examiner*—Weilun Lo
(74) *Attorney, Agent, or Firm*—Sughrue, Mion, Zinn, Macpeak & Seas, PLLC

(57) ABSTRACT

A valve timing control system for an internal combustion engine capable of accurately accomplishing valve timing control irrespective of variation of the oil pressure to be applied to an hydraulic actuator. The apparatus comprises an hydraulic actuator for changing an operating angle of a cam of a cam shaft to advance or retard a valve timing in the internal combustion engine, a pump for sending a lubricating oil under pressure to the hydraulic actuator, an oil supply quantity adjusting valve for adjusting a quantity of the lubricating oil to be supplied to the hydraulic actuator, and a control unit for estimating a driving force of the hydraulic actuator on the basis of an oil pressure of the lubricating oil on the downstream side of the pump. The controlled variable for the oil supply quantity adjusting valve is determined on the basis of the estimated value of the driving force of the hydraulic actuator.

6 Claims, 11 Drawing Sheets

Ⓐ : CAM SHAFT OPERATING FORCE IS WEAK

Ⓑ : CAM SHAFT OPERATING FORCE IS STRONG

VALVE TIMING CONTROL SYSTEM FOR INTERNAL COMBUSTION ENGINE

BACKGROUND OF THE INVENTION

1. Field of the Invention

The present invention relates to a valve timing control system for an internal combustion engine, equipped with a hydraulic actuation type variable valve timing mechanism.

2. Description of the Related Art

FIG. 14 schematically shows a construction of a conventional valve timing control system for use in an internal combustion engine.

As FIG. 14 shows, the conventional valve timing control system is made up of an oil pump 1 for supplying a lubricating oil under pressure to a valve timing control system, a cam shaft 2 for opening and closing intake valves and exhaust valves in the internal combustion engine, a VVT (Variable Valve Timing) actuator 3 for varying the rotational phase of the cam shaft 2 with respect to a crank shaft (not shown), an oil control valve 4 for adjusting the quantity of the lubricating oil to be supplied to the VVT actuator 3, a crank shaft rotational-phase detecting means 5 for detecting a rotational phase of the crank shaft, a cam shaft rotational-phase detecting means 6 for detecting a rotational phase of the cam shaft 2, an operational-state detecting means 7 for detecting an operational state of the internal combustion engine, an oil control valve drive circuit 8 for driving the oil control valve 4 electrically, and an ECU 9 for issuing a command to the oil control valve drive circuit 8.

In this construction, the VVT actuator 3 is composed of a cam pulley 2*a* rotating in synchronism with the crank shaft (the speed of rotation is ½ of that of the crankshaft), and an advance (spark-advance) chamber 3*a*, a retardation (spark-retardation) chamber 3*b* and a rotor 3*c* for rotationally shifting the cam shaft 2 to the advancing side or the retarding side.

Secondly, a description will be given hereinbelow of an operation of the conventional valve timing control system for use in the internal combustion engine.

On the basis of the operational state (engine speed, throttle opening degree, charging efficiency, cooling water temperature and others) of the internal combustion engine the operational-state detecting means 7 detects, the ECU 9 is made to determined the optimal valve timing. Additionally, as a function of the phases of the crank shaft and the cam shaft 2 the crank shaft rotational-phase detecting means 5 and the cam shaft rotational-phase detecting means 6 detect respectively, the ECU 9 calculates the present valve timing.

The ECU 9 calculates a controlled variable (actuation) for the oil control valve 4 so that the deviation between the optimal valve timing and the present valve timing decreases, with this controlled variable being forwarded to the oil control valve drive circuit 8.

The oil control valve drive circuit 8 adjusts the voltage or the current to be supplied to the oil control valve 4 on the basis of a command from the ECU 9 so that the controlled variable commanded by the ECU 9 corresponds to an electrical behavior of the oil control valve 4.

The lubricating oil fed under pressure from the oil pump 1 to the oil control valve 4 is distributed to an advance side oil passage 3*d* or a retardation side oil passage 3*e*, communicating with the advance chamber 3*a* or the retardation chamber 3*b*, in the oil control valve 4, thereby entering the advance chamber 3*a* or the retardation chamber 3*b*.

For the advance of the valve timing, the lubricating oil is supplied into the advance chamber 3*a* while the lubricating oil in the interior of the retardation chamber 3*b* is returned through a drain of the oil control valve 4 to an oil pan. Since the cam shaft 2 is connected coaxially with the rotor 3*c* in the VVT actuator 3, the rotor 3*c* is rotated by the oil pressure to the advance side with respect to the cam pulley 2*a* so that the rotational phase of the cam shaft 2 advances relative to the rotational phase of the crank shaft.

On the other hand, for the retardation of the valve timing, the lubricating oil is given to the retardation chamber 3*b* while the lubricating oil in the interior of the advance chamber 3*a* is returned through the drain of the oil control valve 4 to the oil pan. This operation reverse to the advancing operation causes the retardation of the valve timing.

The driving force of the VVT actuator 3 is determined from an operational torque of the cam shaft and a pressure of the lubricating oil supplied from the oil pump 1, while the conventional valve timing control system has been designed such that the pressure of the lubricating oil and the operational torque of the cam shaft 2 have been estimated from a detection signal (for example, engine speed or cooling water temperature) of the operational-state detecting means 7.

However, the pressure of the lubricating oil not only depends on the characteristic of the lubricating oil, the variation of the oil temperature and the degree of the deterioration thereof, but also varies, for example, due to the variation of the delivery pressure of the oil pump 1 resulting from the bias of the lubricating oil in the oil pan or the like at the decrease in the oil quantity, at the acceleration/deceleration or at the high-speed turning or due to the increase in the pressure loss stemming from the accumulation of foreign matters in the oil supply passages, even if the internal combustion engine takes the same operating conditions.

In addition, the operational torque of the cam shaft varies with the engine speed and the viscosity of the lubricating oil.

For this reason, there is a problem which arises with the conventional control method of determining the controlled variable by estimating the driving force of the VVT actuator 3 on the basis of only the operational state, however, in that the controllability of the valve timing becomes variable.

Additionally, as the case in which the pressure of the supply oil by the VVT actuator 3 drops significantly, there may be an extremely high oil temperature plus a low engine speed, or the accumulation of foreign matters in the oil supply passages. In these cases, the driving force of the VVT actuator 3 falls, which creates a problem in control of the valve timing to a desired value.

Still additionally, the combustion state of the internal combustion engine becomes unstable.

SUMMARY OF THE INVENTION

Accordingly, the present invention has been developed with view to solving the above-mentioned problems, and it is an object of the invention to provide a valve timing control system for use in an internal combustion engine, which estimates a driving force of a VVT actuator on the basis of an oil pressure of a lubricating oil to be supplied to the VVT actuator, so that the controllability of the valve timing can be maintained regularly and the combustion state of the internal combustion engine becomes stable.

For this purpose, in accordance with this invention, there is provided a valve timing control system for an internal combustion engine, comprising an hydraulic actuator for changing an operating angle of a cam of a cam shaft to advance or retard a valve timing in the internal combustion engine, a pump for sending a lubricating oil under pressure to the hydraulic actuator, an oil supply quantity adjusting valve for adjusting a quantity of the lubricating oil to be supplied to the hydraulic actuator, and control means for estimating a driving force of the hydraulic actuator on the basis of an oil pressure of the lubricating oil on the downstream side of the pump to determine a controlled variable on the basis of the estimated value of the driving force of the hydraulic actuator. Accordingly, it is possible to accomplish the valve timing control without depending upon the variation of the oil pressure due to the variation of the property and quantity of the lubricating oil, the variation of the operational state of the motor vehicle, the variation of the conditions in the oil supply passages, or the like.

In addition, the aforesaid control means determines the controlled variable, irrespective of variation of the driving force of the hydraulic actuator, so that the controllability of the valve timing becomes substantially constant. Accordingly, the valve timing control becomes possible with high controllability.

Still additionally, the aforesaid control means sets a control gain for valve timing control to a larger value when the estimated value of the driving force of the hydraulic actuator is small than when the estimated value of the driving force of the hydraulic actuator is large. Accordingly, the valve timing control becomes possible to perform with high controllability irrespective of the variation of the driving force of the hydraulic actuator.

Furthermore, the valve timing control system further comprises oil pressure detecting means mounted on the downstream side of the pump for detecting a pressure of the lubricating oil to be supplied to the hydraulic actuator, oil temperature detecting means for detecting a temperature of the lubricating oil, and operational-state detecting means for detecting an operational state of the internal combustion engine, while the control means estimates a force for an operation of the cam shaft on the basis of the oil temperature detected by the oil temperature detecting means and the operational state detected by the operational-state detecting means, and calculates a rotating force to the cam shaft by the oil pressure of the lubricating oil to be supplied to the hydraulic actuator on the basis of the oil pressure detected by the oil pressure detecting means, and further estimates a driving force, the hydraulic actuator exerts for changing the operating angle of the cam, on the basis of the force for the operation of the cam shaft and the rotating force to the cam shaft. Accordingly, it is possible to accomplish the valve timing control without depending upon the variation of the oil pressure due to the variation of the property and quantity of the lubricating oil, the variation of the operational state of the motor vehicle, the variation of the conditions in the oil supply passages, or the like.

Still furthermore, the valve timing control system further comprises oil pressure detecting means mounted on the downstream side of the pump for detecting a pressure of the lubricating oil to be supplied to the hydraulic actuator and operational-state detecting means for detecting an operational state of the internal combustion engine including at least a speed of the internal combustion engine, while the control means estimates a force for an operation of the cam shaft on the basis of the oil pressure detected by the oil pressure detecting means and the operational state of the internal combustion engine detected by the operational-state detecting means, and calculates a rotating force to the cam shaft by an oil pressure of the lubricating oil to be supplied to the hydraulic actuator on the basis of the oil pressure detected by the oil pressure detecting means, and further estimates a driving force, the hydraulic actuator exerts for changing the operating angle of the cam, on the basis of the force for the operation of the cam shaft and the rotating force to the cam shaft. Accordingly, the reduction of the apparatus cost becomes feasible.

Moreover, the valve timing control system further comprises oil temperature detecting means for detecting a temperature of the lubricating oil and operational-state detecting means for detecting an operational state of the internal combustion engine including at least a speed of the internal combustion engine, while the control means estimates a force for an operation of the cam shaft on the basis of the oil temperature detected by the oil temperature detecting means and the operational state of the internal combustion engine detected by the operational-state detecting means, and calculates a rotating force to the cam shaft by an oil pressure of the lubricating oil to be supplied to the hydraulic actuator on the basis of the operational state of the internal combustion engine detected by the operational-state detecting means and the oil temperature detected by the oil temperature detecting means, and further estimates a driving force, the hydraulic actuator exerts for changing the operating angle of the cam, on the basis of the force for the operation of the cam shaft and the rotating force to the cam shaft. Accordingly, the reduction of the apparatus cost becomes feasible.

BRIEF DESCRIPTION OF THE DRAWINGS

The object and features of the present invention will become more readily apparent from the following detailed description of the preferred embodiments taken in conjunction with the accompanying drawings in which.

DESCRIPTION OF THE PREFERRED EMBODIMENTS

First Embodiment

Figure 1:
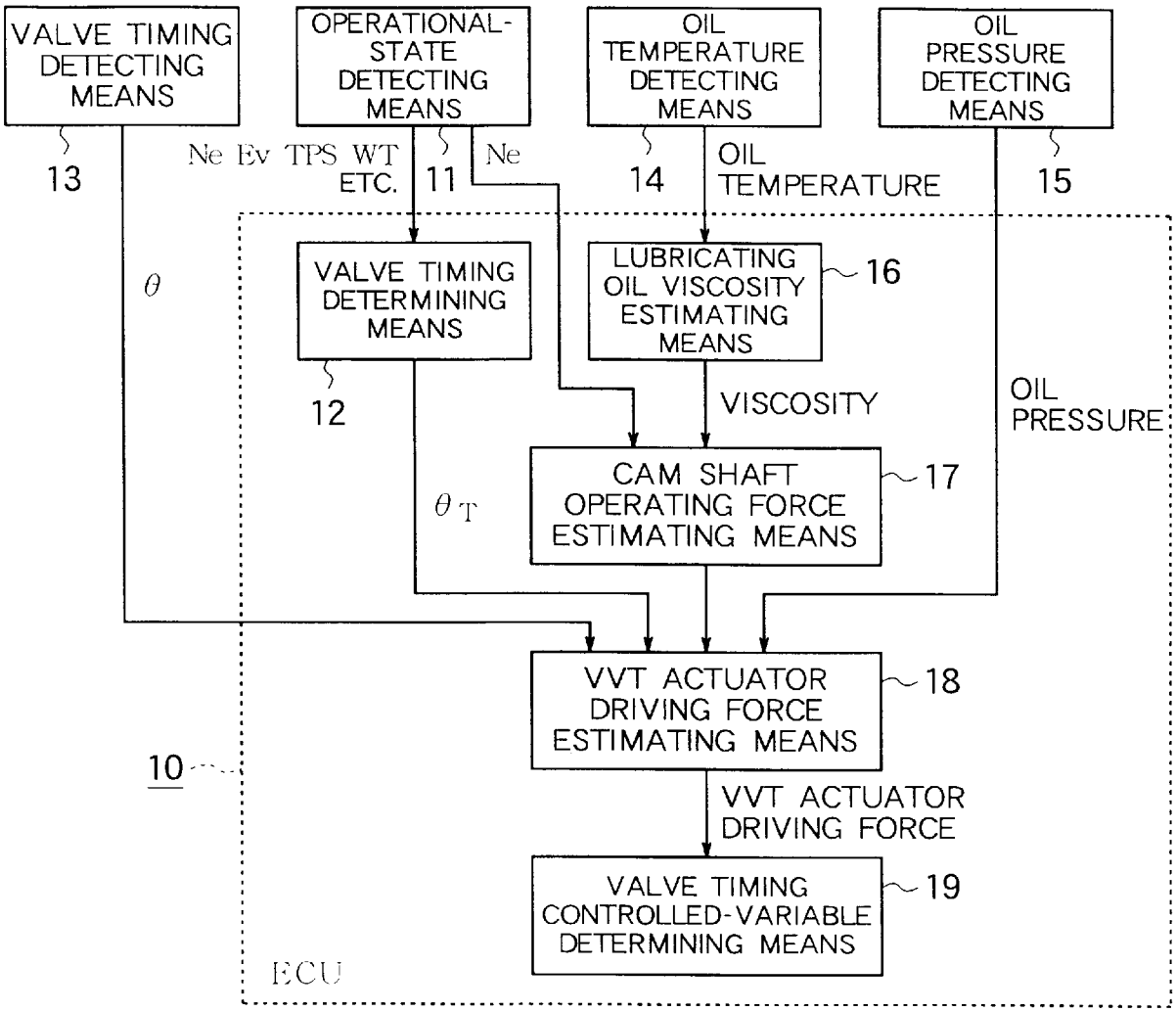
FIG. 1 is a block diagram schematically showing a configuration of a valve timing control system for an internal combustion engine according to a first embodiment of this invention.

FIG. 1 is a block diagram schematically showing a configuration of a valve timing control system for an internal combustion engine according to a first embodiment of this invention.

As shown in FIG. 1, a control system for the internal combustion engine according to the first embodiment of this invention is provided with an operational-state detecting means 11, a valve timing determining means 12, a valve timing detecting means 13, an oil temperature detecting means 14, an oil pressure detecting means 15, a lubricating oil viscosity estimating means 16, a cam shaft operating force estimating means 17, a VVT actuator driving force estimating means 18 and a valve timing controlled-variable determining means 19.

Figure 2:
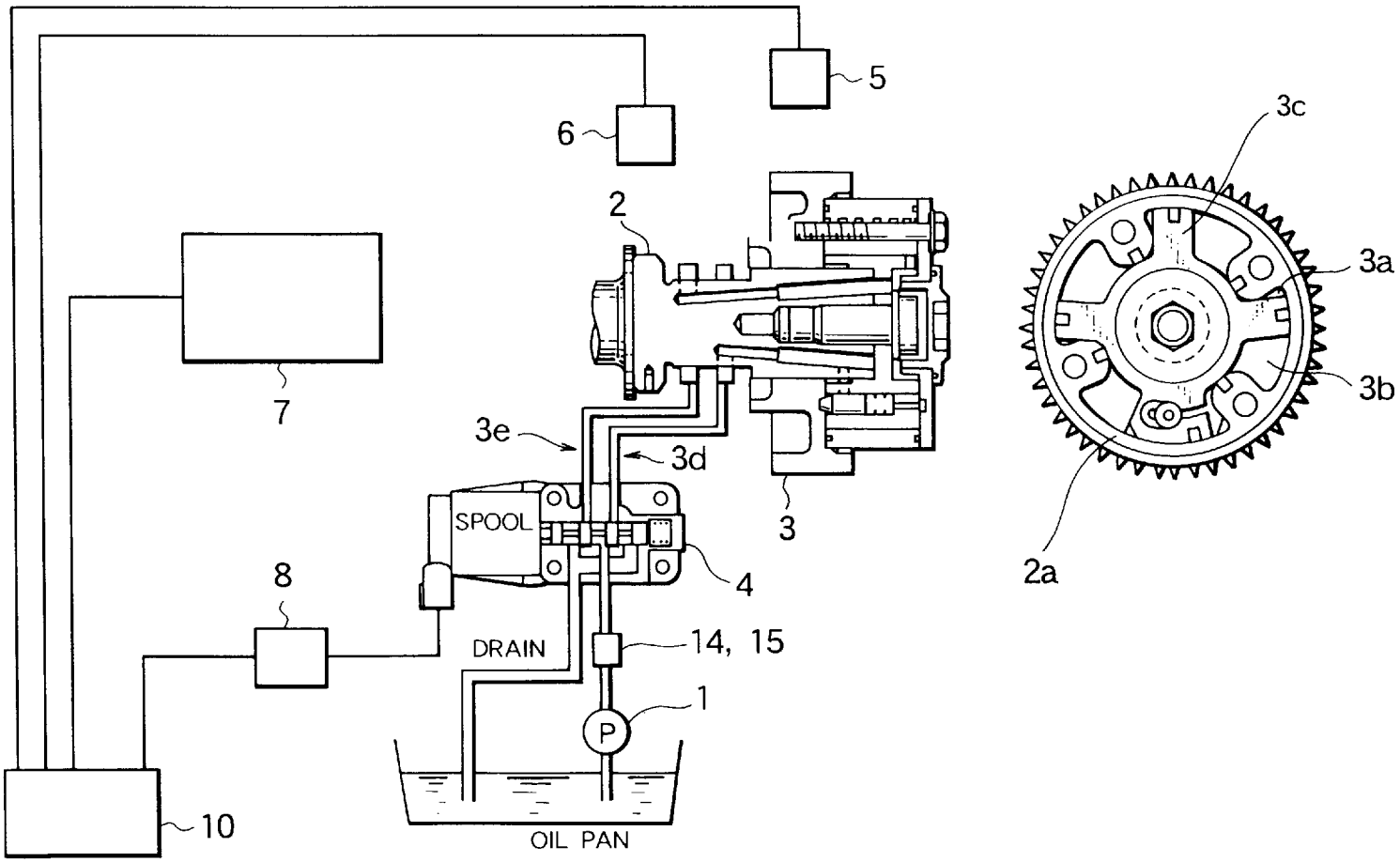
FIG. 2 is a schematic illustration of a construction of the internal combustion engine valve timing control system according to a first embodiment of this invention.

FIG. 2 schematically shows a construction of the internal combustion engine valve timing control system according to the first embodiment of this invention.

As shown in FIG. 2, the internal combustion engine valve timing control system according to the first embodiment of this invention is, as well as the conventional apparatus, composed of an oil pump 1, a cam shaft 2, a VVT actuator 3 serving as an hydraulic actuator, an oil control valve 4 serving as a supplying oil quantity adjusting valve, a crank shaft rotational-phase detecting means 5, a cam shaft rotational-phase detecting means 6 and an oil control valve drive circuit 8.

As shown in FIG. 2, the oil temperature detecting means 14 and the oil pressure detecting means 15 are disposed on the downstream side of the oil pump 1 forming a pump for sending a lubricating oil under pressure to the VVT actuator 3, and preferably situated between the oil pump 1 and the oil control valve 4. Incidentally, the oil temperature detecting means 14 is not always necessary to place on the downstream side of the oil pump 1 as long as it is positioned to enable the detection of the temperature of the lubricating oil to be supplied to the VVT actuator 3 and all parts of the cam shaft 2.

Furthermore, an ECU 10 is an engine control unit including the valve timing determining means 12, the lubricating oil viscosity estimating means 16, the cam shaft operating force estimating means 17, the VVT actuator driving force estimating means 18 and the valve timing controlled-variable determining means 19 which are respectively shown in FIG. 1, and is for controlling the lubricating oil quantity to be supplied to the VVT actuator 3 on the basis of the oil pressure and oil temperature of the lubricating oil on the downstream side of the oil pump 1.

In the valve timing control system for an internal combustion engine thus constructed, the operational-state detecting means 11 is made to detect an engine speed (Ne), a throttle opening degree (TPS), a charging efficiency (Ev), a cooling water temperature (WT) and others as an operational state of the internal combustion engine,.

The valve timing determining means 12 is made to determine the optimal valve timing on the basis of the engine speed and other parameters detected by the operational-state detecting means 11.

The valve timing detecting means 13 is made to detect the present valve timing on the basis of detection signals of the crank shaft rotational-phase detecting means 5 and the cam shaft rotational-phase detecting means 6.

The oil temperature detecting means 14 and the oil pressure detecting means 15 are made to detect a temperature of the lubricating oil, and a temperature and a pressure of the lubricating oil which is to be supplied to the VVT actuator 3, respectively.

The lubricating oil viscosity estimating means 16 is made to estimate viscosity of the lubricating oil on the basis of the oil temperature detected by the oil temperature detecting means 14.

The cam shaft operating force estimating means 17 is made to estimate an operating force of the cam shaft 2 on the basis of an engine speed forming the operational state detected by the operational-state detecting means 11 and the lubricating oil viscosity estimated by the lubricating oil viscosity estimating means 16.

The VVT actuator driving force estimating means 18 is made to estimate a driving force (which will be referred to hereinafter as a VVT actuator driving force), the VVT actuator 3 exerts for changing an operating angle of a cam, on the basis of the present valve timing, the optimal valve timing, the estimated value of the operating force of the cam shaft 2 and the oil pressure.

The valve timing controlled-variable determining means 19 is made to control the valve timing by determining a controlled variable of the oil control valve 4 on the basis of the estimated value of the VTT actuator driving force.

Although the valve timing determining means 12, the lubricating oil viscosity estimating means 16, the cam shaft operating force estimating means 17, the VVT actuator driving force estimating means 18 and the valve timing controlled-variable determining means 19 are shown in FIG. 1 for the purpose of schematically showing a configuration of the ECU 10 functioning as a control means, but the functions of the ECU 10 are not limited to these means, but the ECU 10 further has functions for performing all the calculations or operations needed in an operational flow which is to be described hereinbelow.

Secondly, a description will be given of an operation.

Figure 3:
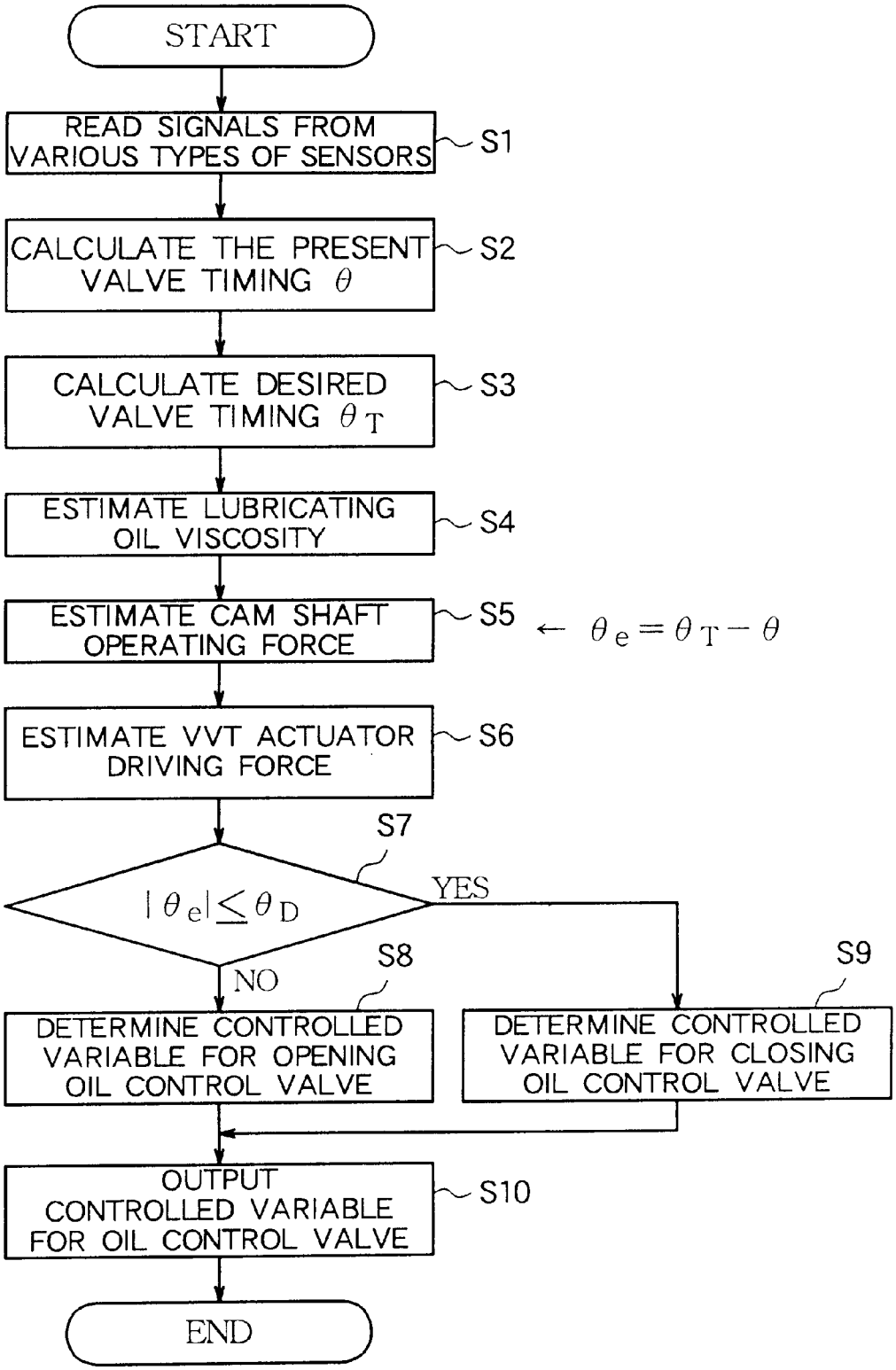
FIG. 3 is a flow chart showing the control contents of the internal combustion engine valve timing control system according to the first embodiment of this invention.
Figure 4:
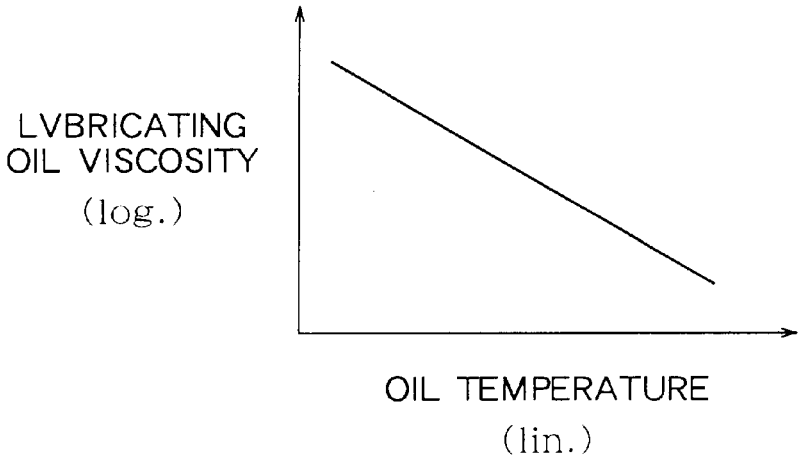
FIG. 4 is a characteristic diagram showing the relationship between a temperature of a lubricating oil and a viscosity thereof in the first embodiment of this invention.
Figure 5:
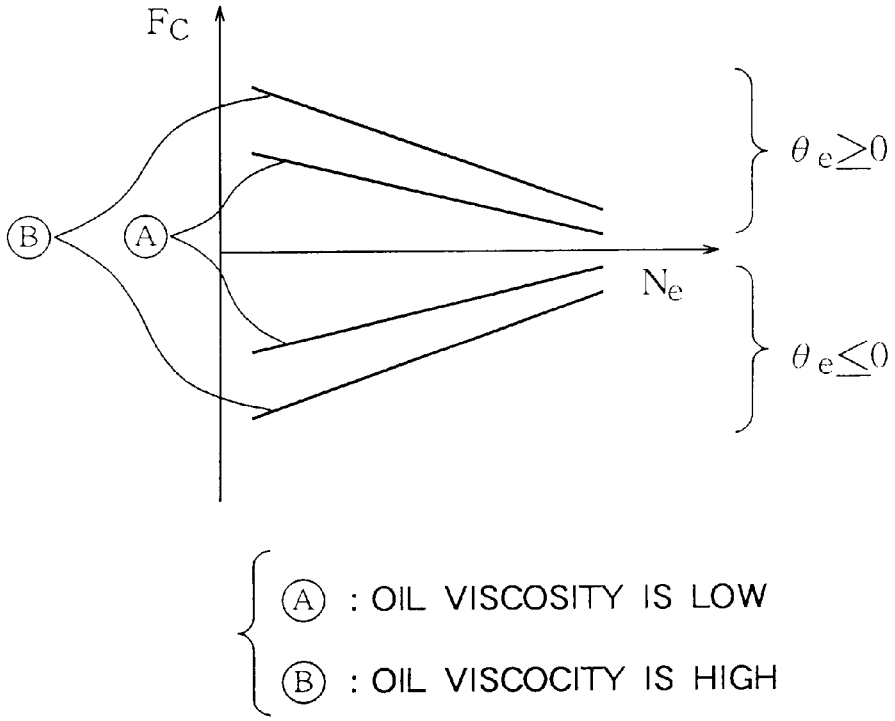
FIG. 5 is a characteristic diagram showing the relationship between an engine speed and a cam shaft operating force in the first embodiment of this invention.
Figure 6:
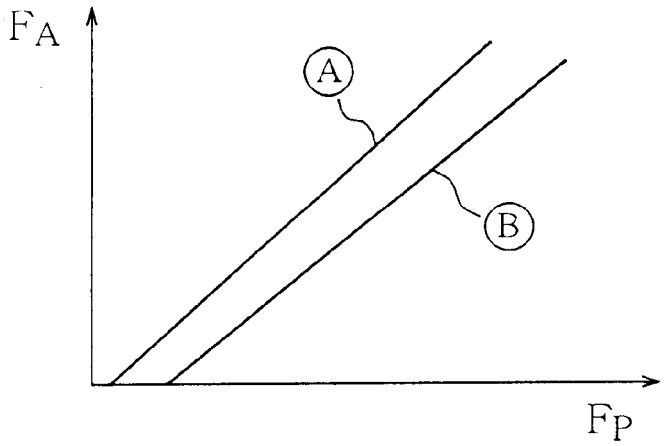
FIG. 6 is a characteristic diagram showing the relationship between a rotating force to the cam shaft and a VVT actuator driving force in the first embodiment of this invention.
Figure 7:
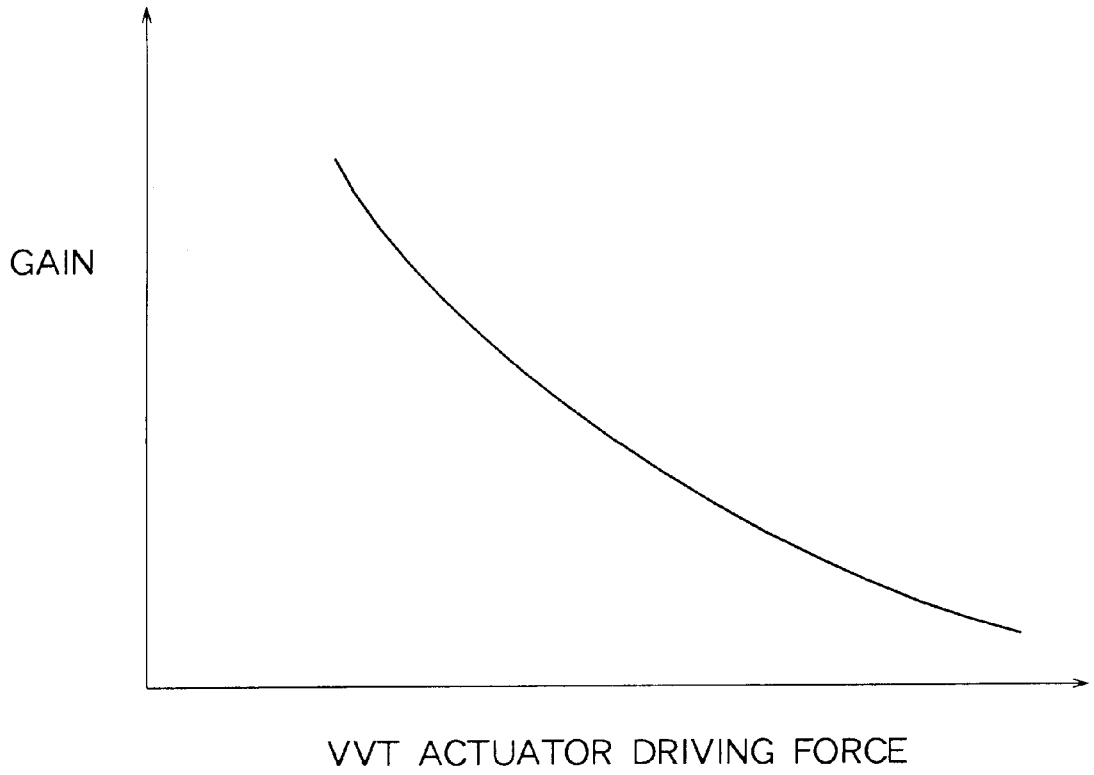
FIG. 7 is an illustration of a characteristic of a control gain to be set in accordance with an estimated VVT actuator driving force.

FIG. 3 is a flow chart showing the control contents of the internal combustion engine valve timing control system according to the first embodiment of this invention. FIG. 4 is a characteristic diagram showing the relationship between a temperature of a lubricating oil and a viscosity thereof in the first embodiment of this invention. FIG. 5 is a characteristic diagram showing the relationship between an engine speed and a cam shaft operating force in the first embodiment of this invention. FIG. 6 is a characteristic diagram showing the relationship between a rotating force to the cam shaft 2 and a VVT actuator driving force in the first embodiment of this invention. FIG. 7 is an illustration of a characteristic of a control gain to be set in accordance with an estimated WVT actuator driving force.

As shown in FIG. 3, a step 1 is first implemented to read detection signals (for example, an engine speed, a throttle opening degree and others) obtained by the operational-state detecting means 11, the crank shaft rotational-phase detecting means 5 and the cam shaft rotational-phase detecting means 6 (S1).

A step 2 follows for the ECU 10 to calculate the present valve timing θ on the basis of a rotational phase of the crank shaft and a rotational phase of the cam shaft 2 read in the step 1 (S2).

A step 3 is further implemented to calculate, on the basis of the detection signals (for example, an engine speed, a throttle opening degree, a charging efficiency, a water temperature and others) indicative of the operational state read in the step 1, the most appropriate valve timing (which will be referred to hereinafter as a desired valve timing) θT in this operational state (S3).

A step 4 follows to read a temperature of a lubricating oil (which will simply be referred to hereinafter as an oil temperature) detected by the oil temperature detecting means 14 for estimating a viscosity of the lubricating oil on the basis of the characteristic shown in FIG. 4 (S4).

A step 5 is still further implemented to calculate the deviation θe of the present valve timing θ from the desired valve timing θT for estimating a force needed for operating the cam shaft 2 (which will be referred to hereinafter as a cam shaft driving force $F_c$) from the characteristic in FIG. 5 on the basis of the lubricating oil viscosity estimated in the step 4 and the engine speed (S5). This cam shaft operating force $F_c$ depends upon, for example, the frictional forces between the shaft and the cam bearing and between the cam and the valve lifter.

A step 6 follows to estimate a force $F_A$ the VVT actuator 3 exerts for changing the operating angle of the cam (which will be referred to hereinafter as a VVT actuator driving force $F_A$) Concretely, the oil pressure detected by the oil detecting means 15 is read to calculate a force $F_p$ the oil pressure supplied from the VVT actuator 3 exerts for rotating the cam shaft 2. Additionally, the WVT actuator driving force $F_A$ is estimated as a function of the cam shaft driving force $F_c$, estimated in the step 5, through the use of an equation (1) according to the characteristic in FIG. 6 (S6).

$$F_A = F_p - F_c \tag{1}$$

In this way, the VVT actuator driving force $F_A$ forming a force, the VVT actuator 3 actually exerts for changing the phase of the cam shaft 2 with respect to the rotational phase of the shaft, is expressed as the difference between the force Fp (a rotating force $F_p$ to the cam shaft 2), the oil pressure of the lubricating oil supplied to the VVT actuator 3 exerts for rotating the cam shaft 2, and the cam shaft operating force $F_c$ estimated in the step 5.

Furthermore, the operational flow advances to a step 7 to determine an actuation of the oil control valve 4 on the basis of the relationship in magnitude between the deviation θe of the present valve timing θ relative to the desired valve timing OT and a dead zone OD. The oil control valve 4 is driven to take an open condition (step 8 which will be mentioned later) when the deviation Oe is larger than the dead zone θD, whereas it is operated to take a closed condition when the deviation θe is smaller than the dead zone θD (step 9 which will be mentioned later).

Incidentally, even if this dead zone θD is set at zero (that is, even if the dead zone is not set), this invention is likewise practicable. That is, in such a case, the control is implemented at all times regardless of the magnitude of the deviation between desired valve timing and the present valve timing.

Subsequently, the operational flow proceeds to a step 8 to determine a controlled variable for opening the oil control valve 4. For instance, in the case of using the PID control for the determination of the controlled variable, the controlled variable is determined on the basis of θe calculated in the step 7 and the control gain set in accordance with the VVT actuator driving force estimated in the step 6.

FIG. 7 is a characteristic illustration of a control gain to be set according to the estimated VVT actuator driving force.

As shown in FIG. 7, the control gain is set at a larger value as the estimated value of the VVT actuator driving force decreases. That is, since the control response time becomes longer with the decrease in the driving force of the VVT actuator 3, the control gain is set at a large value when the driving force of the VVT actuator 3 assumes a small value to increase the controlled variable of the oil control valve 4, so that the control gain is set to always provide a constant control response irrespective of the variation of the driving force of the VVT actuator 3.

In a step 9, as well as the operation in the step 8, a controlled variable is determined for closing the oil control valve 4.

Thereafter, in a step 10, the controlled variable determined in the step 8 or the step 9 is converted through the oil control valve drive circuit 8 into an electric signal, which in turn, drives the oil control valve 4.

As described above, with the valve timing control system according to the first embodiment of this invention, since the oil pressure forming a drive source for the VVT actuator is measured directly, accurate and regular control becomes feasible irrespective of, for example, the variation of the oil pressure resulting from the variation of the property and quantity of the lubricating oil, the variation of the vehicle operating state, the variation of the circumstances in the oil passage for the supply of the lubricating oil, or the like.

In addition, because the driving force of the VVT actuator is estimated taking into consideration the estimated operational torque of the cam shaft and the driving direction of the actuator, even if the phase of the cam is changed in any one of the advance side direction and the retardation side direction, stable control becomes possible.

Still additionally, since precise detection of the decrease in the oil pressure to be applied to the VVT actuator is possible, if the oil pressure decreases significantly, this decrease of the oil pressure is detected accurately to fix the VWT actuator at the most stable position (for example, in the case of the intake valve, the operating force of the cam shaft becomes stable at the maximum retardation position); in consequence, the combustion state of the internal combustion engine can be maintained more stably at the decrease in the oil pressure applied to the VVT actuator.

Second Embodiment

Figure 8:
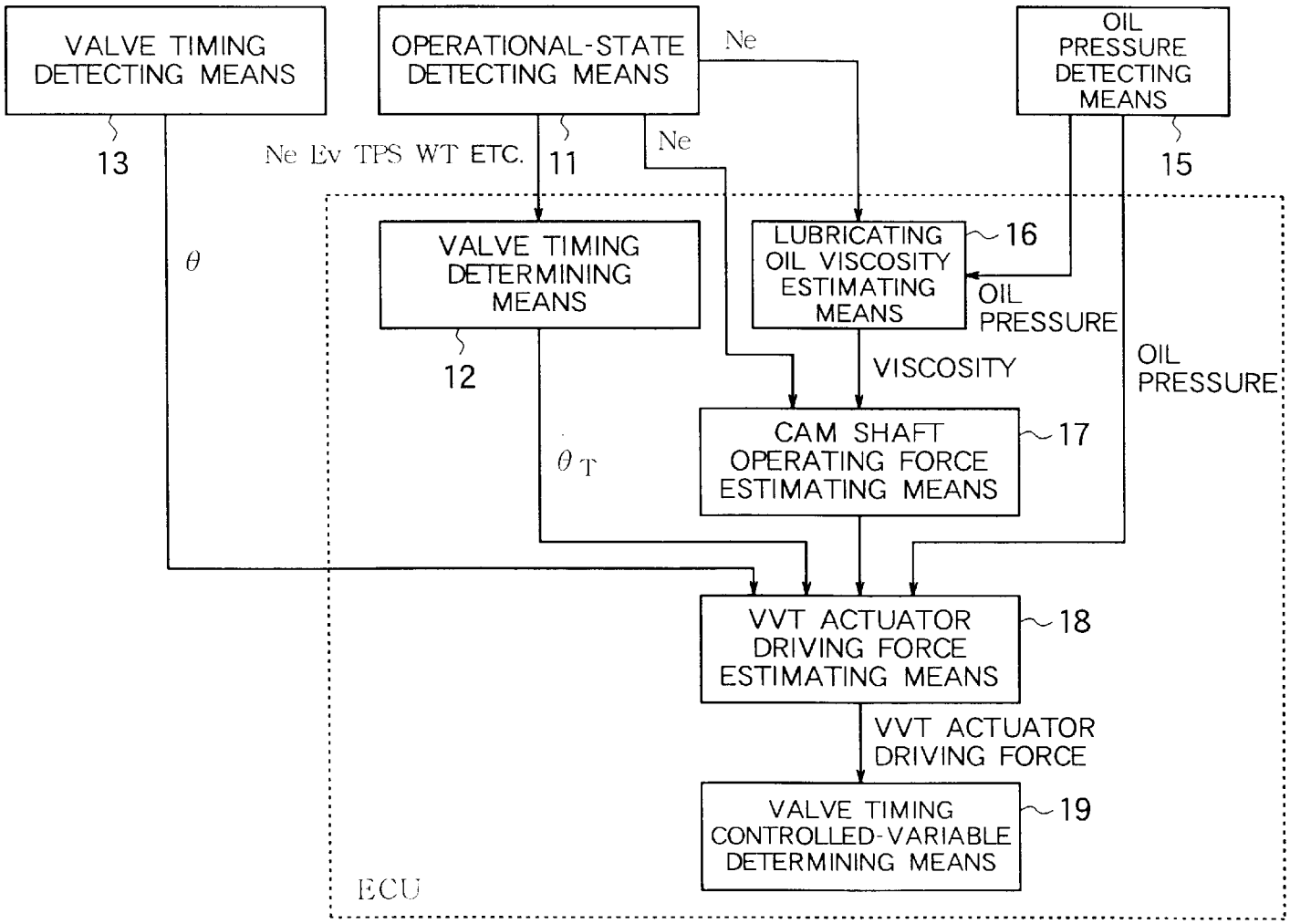
FIG. 8 is a block diagram showing a configuration of a valve timing control system for an internal combustion engine according to a second embodiment of this invention.
Figure 9:
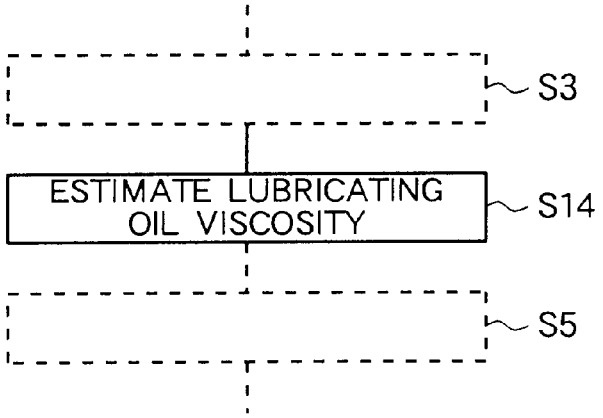
FIG. 9 is a flow chart showing a portion of the control contents of the internal combustion engine valve timing control system according to the second embodiment of this invention.
Figure 10:
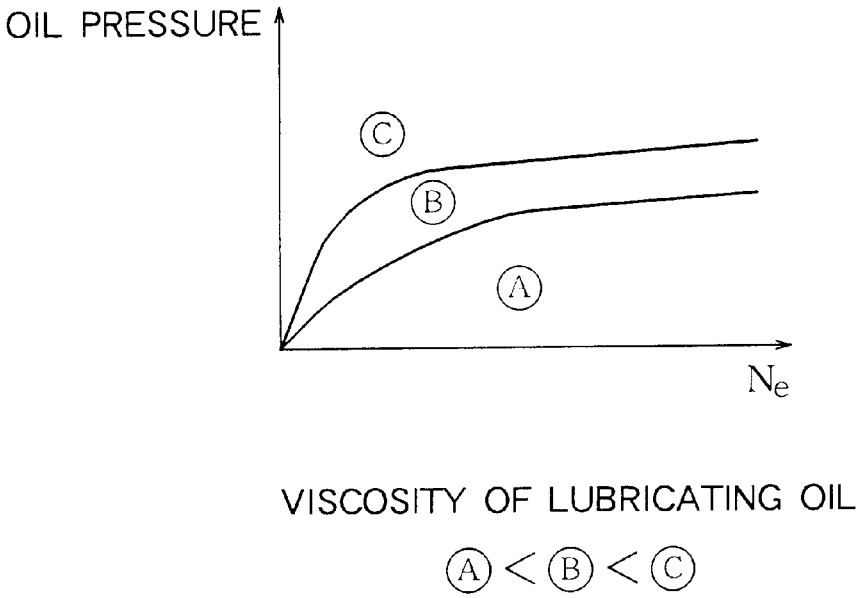
FIG. 10 is a characteristic diagram showing the relationship between an engine speed and an oil pressure.

FIG. 8 is a block diagram showing a configuration of a valve timing control system for use in an internal combustion engine according to a second embodiment of this invention. FIG. 9 is a flow chart showing a portion of the control contents of the internal combustion engine valve timing control system according to the second embodiment of this invention. FIG. 10 is a characteristic illustration of the relationship between an oil pressure and an engine speed with respect to a viscosity.

As shown in FIG. 8, the internal combustion engine valve timing control system according to the second embodiment of this invention is similar to the valve timing control system according to the first embodiment shown in FIG. 1 except that it is not provided with the oil temperature detecting means 14 while a viscosity of the lubricating oil is estimated on the basis of an operational state and an oil pressure so that a driving force $F_A$ of the VVT actuator 3 is estimated on the basis of the estimated value of the viscosity of the lubricating oil and the operational state.

Secondly, a description will be given hereinbelow of a control method employed therein.

As shown in FIG. 9, in the control contents of the internal combustion engine valve timing control system according to the second embodiment of this invention, the step 4 in the control contents according to the first embodiment is replaced with a step 14.

After a desired valve timing θT is calculated in the step 3, in the step 14, a pressure (oil pressure) of the lubricating oil is read through the oil pressure detecting means 15 and a viscosity of the lubricating oil is estimated according to the characteristic shown in FIG. 10 on the basis of the read oil pressure and an engine speed signifying an operational state read in the step 1 (S14).

On the completion of the step 14, the operational flow proceeds to a step 5 identical to that in the first embodiment so that the same operations as those in the first embodiment are subsequently implemented.

As described above, in the valve timing control system according to the second embodiment of this invention, without the use of the oil temperature detecting means, the driving force of the VVT actuator is estimated on the basis of an operational state of the internal combustion engine and an oil pressure of the lubricating oil to be supplied to the VVT actuator, thereby implementing the valve timing control, so that not only the same effects as those of the first embodiment are attainable but also the reduction of the apparatus cost becomes possible.

Third Embodiment

Figure 11:
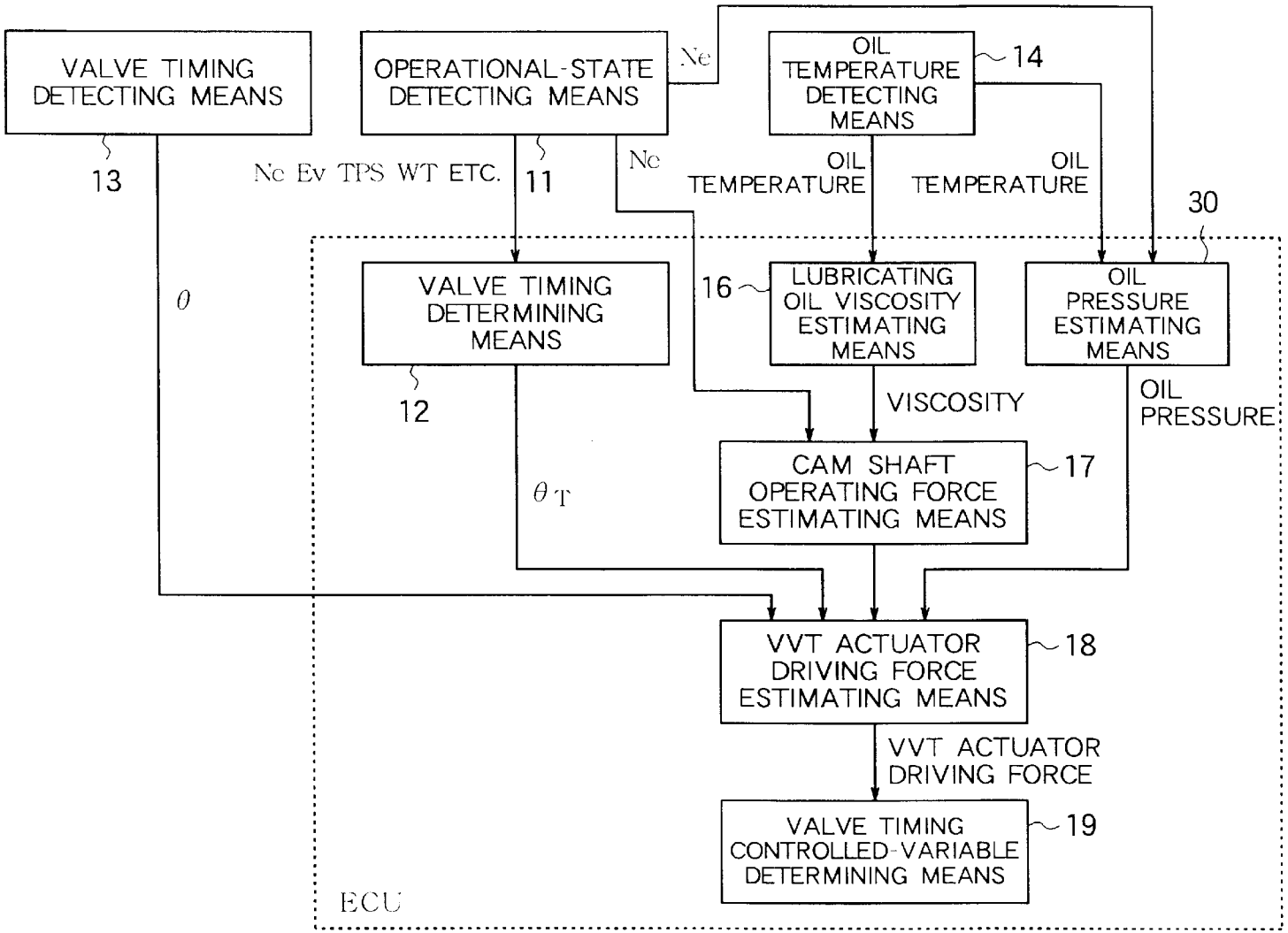
FIG. 11 is a block diagram showing a configuration of a valve timing control system for an internal combustion engine according to a third embodiment of this invention.
Figure 12:
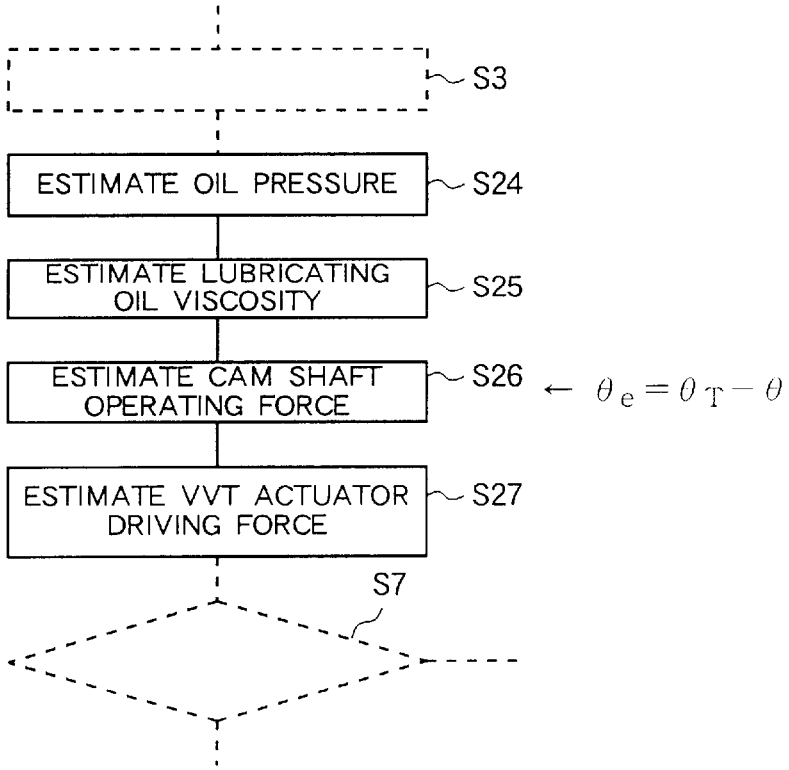
FIG. 12 is a flow chart showing a portion of the control contents of the internal combustion engine valve timing control system according to the third embodiment of this invention.
Figure 13:
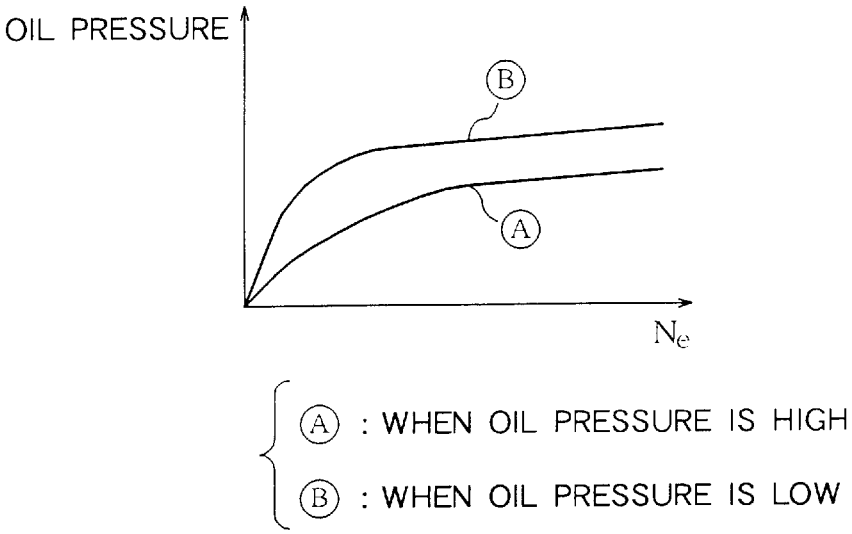
FIG. 13 is a characteristic diagram showing the relationship between an engine speed and an oil pressure.
Figure 14:
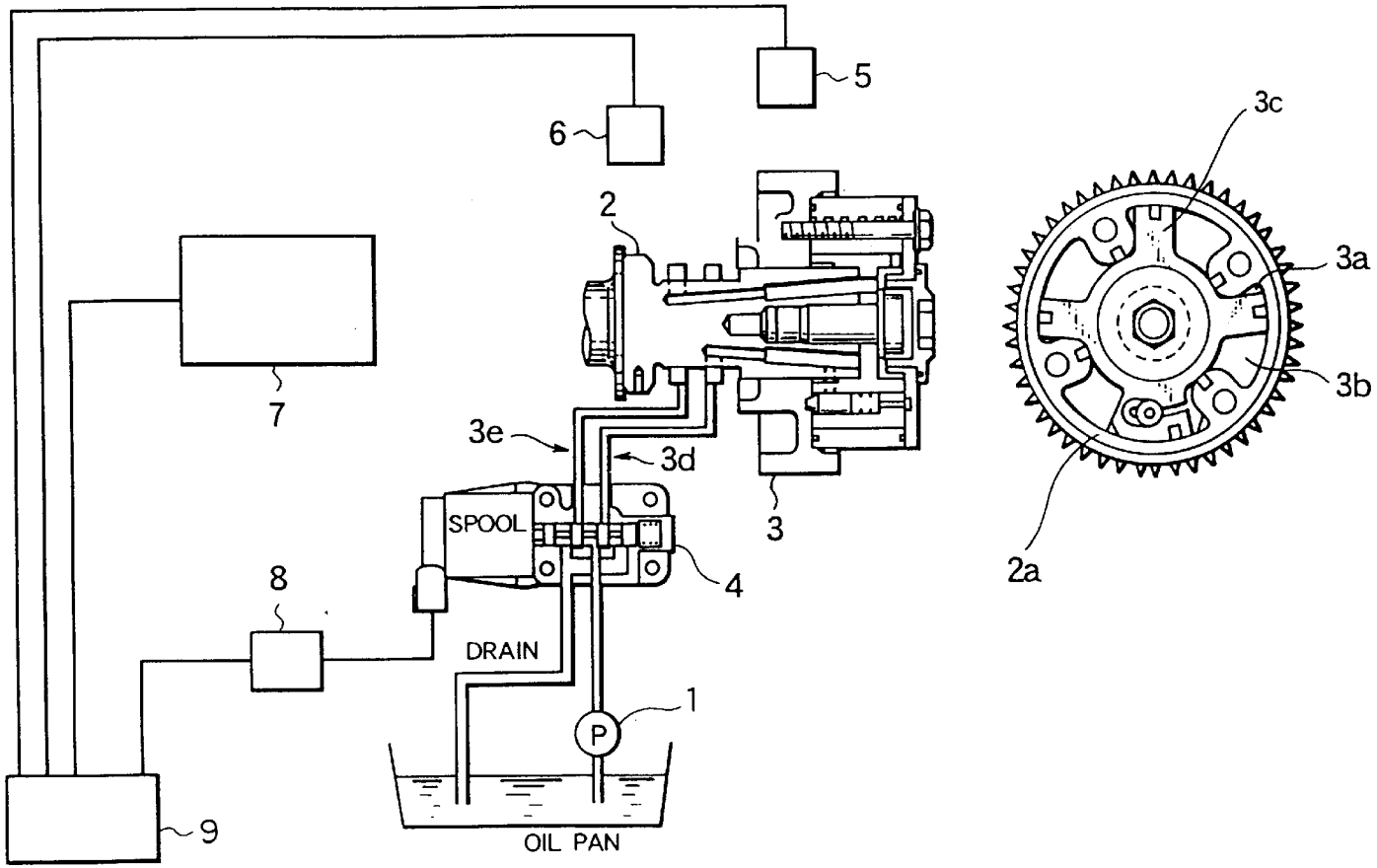
PRIOR ART FIG. 14
FIG. 14 is an illustration of a construction of a conventional valve timing control system for an internal combustion engine.

FIG. 11 is a block diagram showing a configuration of a valve timing control system for use in an internal combustion engine according to a third embodiment of this invention. FIG. 12 is a flow chart showing the control contents of the internal combustion engine valve timing control system according to the third embodiment of this invention. FIG. 13 is a characteristic illustration of the relationship between an oil pressure and an engine speed with respect to an oil temperature.

In FIG. 11, the configuration of this valve timing control system is the same as that of the valve timing control system according to the first embodiment shown in FIG. 1 except that it is not equipped with the oil pressure detecting means 15 and the ECU 10 includes an oil pressure estimating means 30 which is for estimating an oil pressure on the basis of an oil temperature and an operational state of the internal combustion engine.

Secondly, a description will be made hereinbelow of a control method taken therein.

The control flow up to the step 3 is the same as the control contents in the first embodiment, and the description thereof will be omitted for brevity.

In FIG. 12, after the calculation of a desired valve timing θT in the step 3, the operational flow advances to a step 24 in which the oil pressure estimating means 30 estimates an oil pressure according to the relationship in FIG. 13 on the basis of an oil temperature detected by the oil temperature detecting means 14 and an engine speed read in the step 1 (S24).

Furthermore, the operational flow proceeds to a step 25 to estimate a viscosity of the lubricating oil according to the characteristic shown in FIG. 4 on the basis of the oil temperature read in the step 24 (S25).

A step 26 follows to calculate the deviation θe between the desired valve timing and the present valve timing for estimating an operating force of the cam shaft according to the characteristic shown in FIG. 5 on the basis of the viscosity of the lubricating oil estimated in the step 25 and the engine speed (S26).

Still furthermore, the operational flow goes to a step 27 to estimate a VVT actuator driving force according to the characteristic shown in FIG. 6 on the basis of the oil pressure estimated in the step 24 and the cam shaft operating force estimated in the step 26 (S27).

On the completion of the step 27, the operational flow goes to a step 7 identical to that in the first embodiment so that the same flow as that in the first embodiment takes place subsequently.

As described above, in the valve timing control system according to the third embodiment of this invention, without the employment of the oil pressure detecting means, the oil pressure is estimated from an operational state of the internal combustion engine and an oil temperature of the lubricating oil, thereby accomplishing the valve timing control, so that not only the effects corresponding to those of the first embodiment are obtainable but also the reduction of the apparatus cost becomes possible.

It should be understood that the foregoing relates to only preferred embodiments of the present invention, and that it is intended to cover all changes and modifications of the embodiments of the invention herein used for the purpose of the disclosure, which do not constitute departures from the spirit and scope of the invention.

What is claimed is:

1. A valve timing control system for an internal combustion engine, comprising:

an hydraulic actuator for changing an operating angle of a cam of a cam shaft in order to advance or retard a valve timing of said internal combustion engine;

a pump for sending a lubricating oils under pressure to said hydraulic actuator;

an oil supply quantity adjusting valve for adjusting a quantity of said lubricating oil to be supplied to said hydraulic actuator; and control means for estimating a driving force of said hydraulic actuator on the basis of an oil pressure of said lubricating oil on the downstream side of said pump to determine a controlled variable on the basis of the estimated value of the driving force of said hydraulic actuator.

2. A valve timing control system for an internal combustion engine according to claim 1, wherein said control means determines said controlled variable, irrespective of variation of said driving force of said hydraulic actuator, so that controllability of said valve timing becomes substantially constant.

3. A valve timing control system for an internal combustion engine according to claim 1, wherein said control means sets a control gain for valve timing control to a larger value when the estimated value of the driving force of said hydraulic actuator is small than when the estimated value of the driving force of said hydraulic actuator is large.

4. A valve timing control system for an internal combustion engine according to claim 1, further comprising:

oil pressure detecting means mounted on the downstream side of said pump for detecting a pressure of said lubricating oil to be supplied to said hydraulic actuator;

oil temperature detecting means for detecting a temperature of said lubricating oil; and operational-state detecting means for detecting an operational state of said internal combustion engine, said control means estimates a force for an operation of said cam shaft on the basis of the oil temperature detected by said oil temperature detecting means and the operational state detected by said operational-state detecting means, and calculates a rotating force to said cam shaft occurring by an oil pressure of said lubricating oil to be supplied to said hydraulic actuator on the basis of the oil pressure detected by said oil pressure detecting means, and further estimates a driving force, said hydraulic actuator exerts for changing the operating angle of said cam, on the basis of the force for the operation of said cam shaft and the rotating force to said cam shaft.

5. A valve timing control system for an internal combustion engine according to claim 1, further comprising:

oil pressure detecting means mounted on the downstream side of said pump for detecting a pressure of said lubricating oil to be supplied to said hydraulic actuator; and operational-state detecting means for detecting an operational state including at least a speed of said internal combustion engine, said control means estimates a force for an operation of said cam shaft on the basis of the oil pressure detected by said oil pressure detecting means and the operational state of said internal combustion engine detected by said operational-state detecting means, and calculates a rotating force to said cam shaft by an oil pressure of said lubricating oil to be supplied to said hydraulic actuator on the basis of the oil pressure detected by said oil pressure detecting means, and further estimates a driving force, said hydraulic actuator exerts for changing the operating angle of said cam, on the basis of the force for the operation of said cam shaft and the rotating force to said cam shaft.

6. A valve timing control system for an internal combustion engine according to claim 1, further comprising:

oil temperature detecting means for detecting a temperature of said lubricating oil; and operational-state detecting means for detecting an operational state including at least a speed of said internal combustion engine, said control means estimates a force for an operation of said cam shaft on the basis of the oil temperature detected by said oil temperature detecting means and the operational state of said internal combustion engine detected by said operational-state detecting means, and calculates a rotating force to said cam shaft by an oil pressure of said lubricating oil to be supplied to said hydraulic actuator on the basis of the operational state of said internal combustion engine detected by said operational-state detecting means and the oil temperature detected by said oil temperature detecting means, and further estimates a driving force, said hydraulic actuator exerts for changing the operating angle of said cam, on the basis of the force for the operation of said cam shaft and the rotating force to said cam shaft.

* * * * *